US005405722A

United States Patent [19]

Datta et al.

[11] Patent Number: 5,405,722

[45] Date of Patent: Apr. 11, 1995

[54] METHOD FOR COMBINED BAKING-OUT AND SEALING OF AN ELECTROPHOTOGRAPHICALLY PROCESSED SCREEN ASSEMBLY FOR A CATHODE-RAY TUBE

[75] Inventors: Pabitra Datta, Cranbury; Nitin V. DeSai, Princeton; Ronald N. Friel, Hamilton Square; Eugene S. Poliniak, Willingboro, all of N.J.

[73] Assignee: RCA Thomson Licensing Corp., Princeton, N.J.

[21] Appl. No.: 168,487

[22] Filed: Dec. 22, 1993

[51] Int. Cl.[6] ..... G03C 5/00

[52] U.S. Cl. ..... 430/28; 430/23; 430/270

[58] Field of Search ..... 430/23, 28, 270; 65/42.43; 427/68

[56] References Cited

U.S. PATENT DOCUMENTS

| | | | |
|---|---|---|---|
| 3,558,310 | 1/1971 | Mayaud | 96/36.1 |
| 4,493,668 | 1/1985 | Piascinski et al. | 445/40 |
| 4,871,637 | 10/1989 | Kitatani et al. | 430/77 |
| 4,873,164 | 10/1989 | Ono | 430/58 |
| 4,921,767 | 5/1990 | Datta et al. | 430/23 |
| 5,083,959 | 6/1992 | Datta et al. | 445/52 |
| 5,145,511 | 9/1992 | Patel et al. | 65/42 |
| 5,229,234 | 7/1993 | Riddle et al. | 430/28 |
| 5,240,798 | 7/1993 | Ehemann, Jr. | 430/23 |

*Primary Examiner*—S. Rosasco

*Attorney, Agent, or Firm*—Joseph S. Tripoli; Dennis H. Irlbeck; Vincent J. Coughlin, Jr.

[57] ABSTRACT

The invention relates to a method of electrophotographically manufacturing a luminescent screen assembly for a color CRT by utilizing materials whose volatilizable constituents are substantially completely baked-out in the same step in which the faceplate panel is frit sealed to the funnel of the tube envelope. This method eliminates a dedicated panel bake before frit sealing of the panel to the funnel.

2 Claims, 4 Drawing Sheets

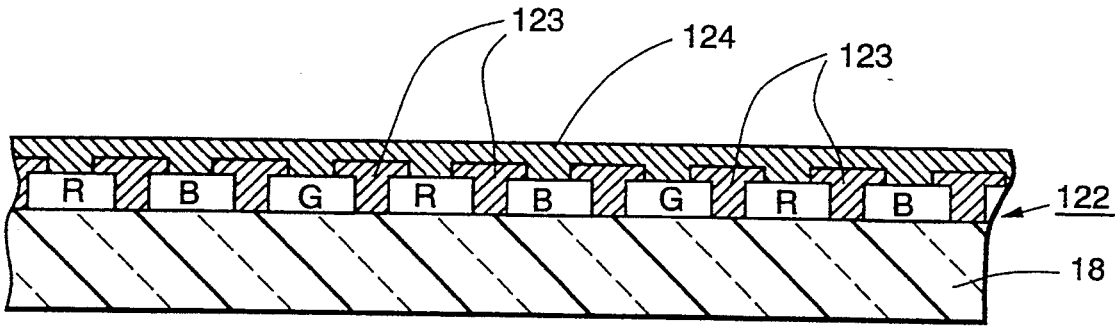
Fig. 5
Fig. 6
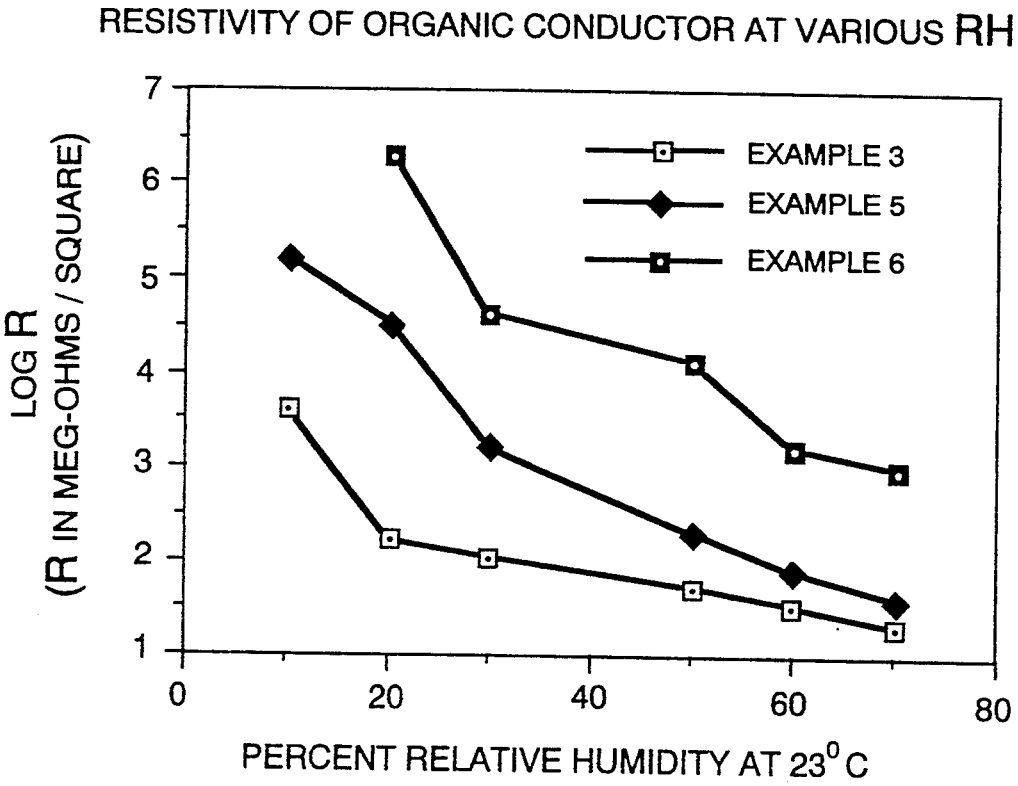

METHOD FOR COMBINED BAKING-OUT AND SEALING OF AN ELECTROPHOTOGRAPHICALLY PROCESSED SCREEN ASSEMBLY FOR A CATHODE-RAY TUBE

The invention relates to a method for manufacturing a screen assembly for a cathode-ray tube (CRT) by the electrophotographic screening (EPS) process, wherein a partially completed screen assembly on a faceplate panel is baked-out and simultaneously sealed to a funnel of the CRT.

BACKGROUND OF THE INVENTION

A CRT, such as a color television picture tube, which is manufactured by the EPS process, is usually prepared by the steps comprising (a) providing a volatilizable photoreceptor, including a conductive layer with an overlying photoconductive layer, on an interior surface of a faceplate panel; (b) establishing a substantially uniform electrostatic charge on the photoreceptor; (c) exposing selected areas of the photoreceptor to actinic radiation to affect the charge distribution thereon; (d) developing the photoreceptor with at least one dry-powdered, light-emitting, triboelectrically-charged screen structure material; (e) fixing, filming and then aluminizing the screen structure material; and (f) baking the faceplate panel, in air, to drive-off the volatile constituents of the photoreceptor, the screen structure material, and the filming material to form the screen assembly. After this initial baking step, the faceplate panel, with the screen assembly on the interior surface thereof, having a color selection electrode mounted therein, and spaced from the screen assembly, is frit sealed to a funnel to form the CRT envelope.

It is desirable to improve the manufacturing efficiency of the above-described process. It is known, for example, in the conventional screen manufacturing art, where the screen and matrix are formed by the so-called, "wet process" described in U.S. Pat. No. 3,558,310, issued to Mayaud on Jan. 26, 1972, to combine the panel bake-out step with the frit sealing step. Such a combined process is described in U.S. Pat. No. 4,493,668 issued to Piascinski et al. on Jan. 15, 1985 and U.S. Pat. No. 5,145,511 issued to Patel et al. on Sep. 8, 1992. However, in the wet process, the number of volatile screen constituents is less than in the EPS process, because in the wet process the layer of photosensitive material initially deposited on the faceplate panel in the formation of the matrix is partially washed off during a development step, and the remainder of the photosensitive material is removed by an etchant. Thus, the volatilizable constituents of a conventional screen include only the matrix and phosphor screen structure materials and the filming material disposed between the screen structure materials and an aluminum layer. In contrast, an EPS manufactured screen includes a volatilizable, two-layered photoreceptor, matrix material, phosphor materials and a filming resin. Thus, if efficiencies in the manufacturing process are to be achieved, a more readily volatilizable photoreceptor must be provided in order to eliminate the present separate panel baking step.

SUMMARY OF THE INVENTION

The present invention relates to a method of manufacturing a luminescent screen assembly for a color CRT having a faceplate panel with a sealing edge that is sealed to a funnel which also has a sealing edge. The method includes the steps of providing a volatilizable photoreceptor on an interior surface of the faceplate panel. The photoreceptor includes a conductive layer and a photoconductive layer. The conductive layer is formed of an organic conductive solution. The photoconductive layer is formed by overcoating the conductive layer with a solution comprising a suitable resin, an electron donor material, at least one electron acceptor material, a surfactant and an organic solvent. The process further includes the steps of:

establishing a substantially uniform electrostatic charge on the photoconductive layer;

exposing selected areas of the photoconductive layer to actinic radiation to affect the charge thereon;

developing the photoconductive layer with at least one dry, light-emitting, triboelectrically-charged screen structure material;

fixing the screen structure material to said photoconductive layer to minimize displacement of the screen structure material;

filming the screen structure material with a suitable filming material;

aluminizing the filmed screen structure material;

locating a color selection electrode within the panel;

providing a bead of frit material on one of the sealing edges, and placing the panel on the funnel with the seal edges in alignment;

supporting the funnel and said panel in a suitable oven; and heating the funnel and the panel above the set temperature of the frit material for a time period sufficient to simultaneously set the frit material and volatilize the photoreceptor and the volatilizable constituents of the screen structure material and the filming material. The process is improved by utilizing an electron donor material in the photoconductive layer of the photoreceptor which is substantially completely decomposed at a temperature below the set temperature of the frit, thereby facilitating the incorporation of the prior panel bake-out step into the present frit sealing step.

CROSS REFERENCE TO RELATED APPLICATION

This application can be used with the invention described in the copending application entitled, "ORGANIC CONDUCTOR FOR AN ELECTROPHOTOGRAPHIC SCREENING PROCESS FOR A CRT", Ser. No. 08/168,485, filed on Dec. 22, 1993.

BRIEF DESCRIPTION OF THE DRAWINGS

FIG. 5 is an alternative embodiment of a screen assembly of the tube shown in FIG. 1.

FIG. 6 is a graph of the resistivity of various conductor layers as a function of percent relative humidity.

DETAILED DESCRIPTION OF THE PREFERRED EMBODIMENT

Figure 1:
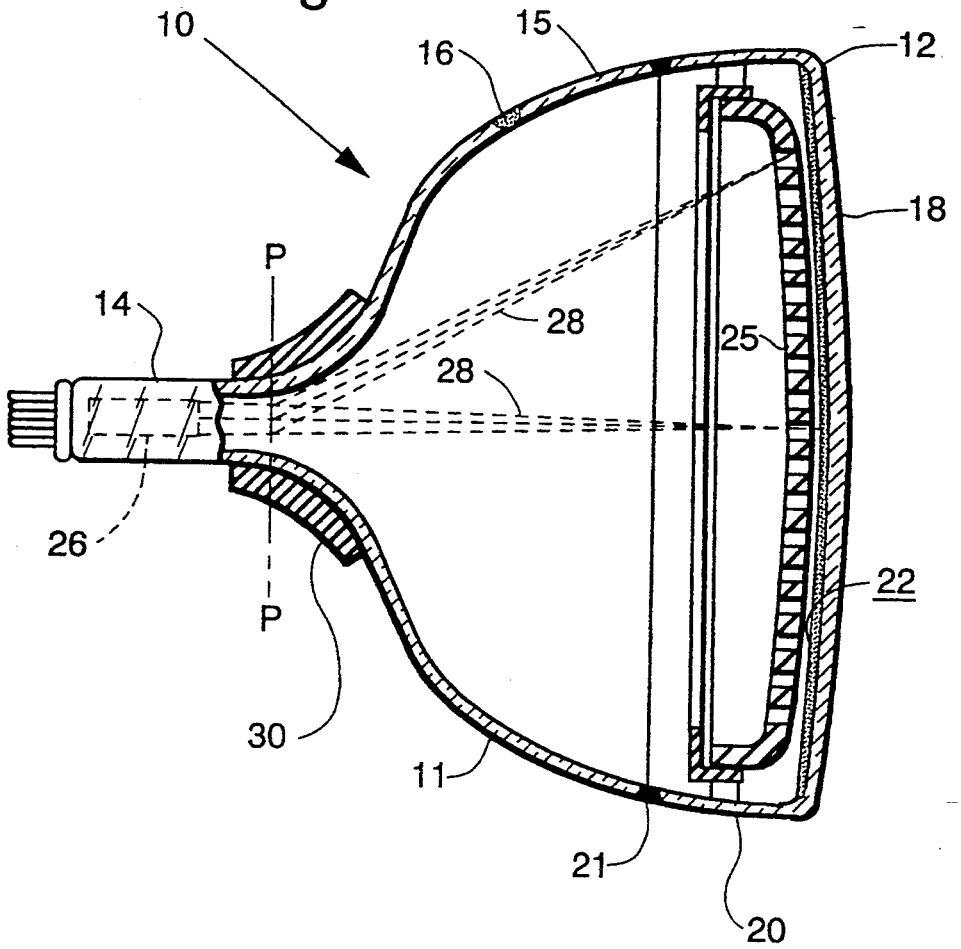
FIG. 1 is a plan view, partially in axial section, of a color CRT made according to the present invention.
Figure 2:
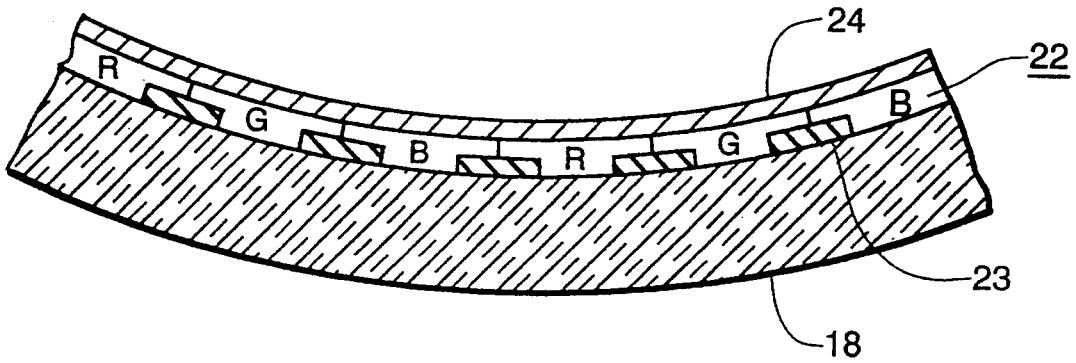
FIG. 2 is a section of a screen assembly of the tube shown in FIG. 1.

FIG. 1 shows a color display device, such as a CRT, 10 having a glass envelope 11 comprising a rectangular faceplate panel 12 and a tubular neck 14 connected by a rectangular funnel 15. The funnel 15 has an internal conductive coating (not shown) that contacts an anode button 16 and extends into the neck 14. The panel 12 comprises a viewing faceplate or substrate 18 and a peripheral flange or sidewall 20, which is sealed to the funnel 15 by a glass frit 21. A three color luminescent screen 22 is carried on the interior surface of the faceplate 18. The screen 22, shown in FIG. 2, preferably is a line screen which includes a multiplicity of screen elements comprised of red-emitting, green-emitting and blue-emitting phosphor stripes, R, G and B, respectively, arranged in color groups or picture elements of three stripes, or triads, in a cyclic order and extending in a direction which is generally normal to the plane in which impinging electron beams are generated. In the normal viewing position for this embodiment, the phosphor stripes extend in the vertical direction. Preferably, the phosphor stripes are separated from each other by a light-absorptive matrix material 23, as is known in the art. Alternatively, the screen can be a dot screen. A thin conductive layer 24, preferably of aluminum, overlies the screen 22 and provides a means for applying a uniform potential to the screen as well as for reflecting light, emitted from the phosphor elements, through the faceplate 18. The screen 22 and the overlying aluminum layer 24 comprise a screen assembly.

Again with respect to FIG. 1, a multi-apertured color selection electrode, or shadow mask, 25 is removably mounted, by conventional means, in predetermined spaced relation to the screen assembly. An electron gun 26, shown schematically by the dashed lines in FIG. 1, is centrally mounted within the neck 14, to generate and direct three electron beams 28 along convergent paths through the apertures in the mask 25 to the screen 22. The gun 26 may, for example, comprise a bi-potential electron gun of the type described in U.S. Pat. No. 4,620,133, issued to Morrell et al., on Oct. 28, 1986, or ally other suitable gun.

The tube 10 is designed to be used with an external magnetic deflection yoke, such as yoke 30, located in the region of the funnel-to-neck junction. When activated, the yoke 30 subjects the three beams 28 to magnetic fields which cause the beams to scan horizontally and vertically in a rectangular raster over the screen 22. The initial plane of deflection (at zero deflection) is shown by the line P—P in FIG. 1, at about the middle of the yoke 30. For simplicity, the actual curvature of the deflection beam paths in the deflection zone is not shown.

Figure 4:
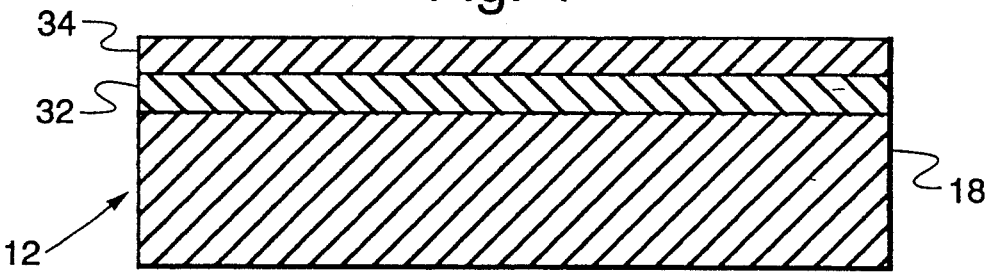
FIG. 4 is a section of a faceplate panel showing a photoconductive layer overlying the present conductive layer.
Figure 3:
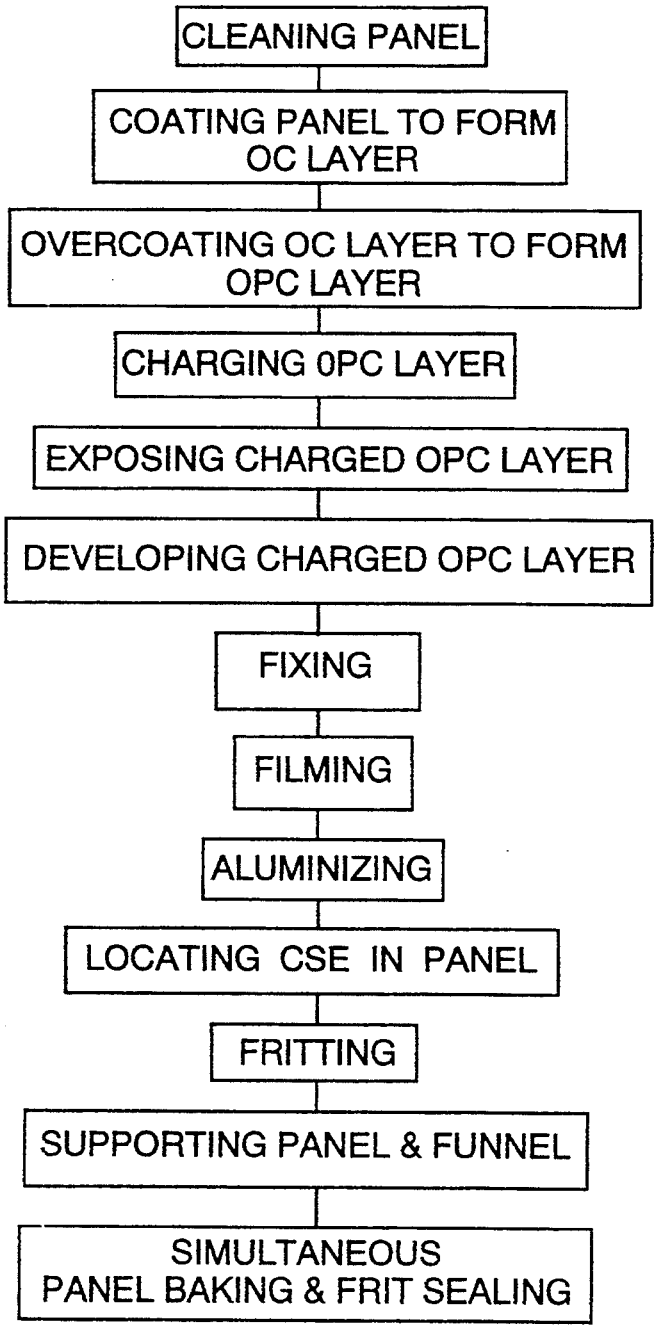
FIG. 3 is a block diagram of the processing sequence utilized in the electrophotographic screening process.

The screen 22 is manufactured by the electrophotographic screening (EPS) process that is described in U.S. Pat. No. 4,921,767, cited above, and shown in block diagram in FIG. 3. Initially, the panel 12 is washed with a caustic solution, rinsed in water, etched with buffered hydrofluoric acid and rinsed again with water, as is known in the art. The interior of the viewing faceplate 18 is then provided with a photoreceptor comprising a suitable layer 32, preferably, of an organic conductive (OC) material which provides an electrode for an overlying organic photoconductive (OPC) layer 34. The OC layer 32 and the OPC layer 34 are shown in FIG. 4.

In order to form the matrix by the EPS process, the OPC layer 34 is charged to a suitable potential within the range of +200 to +700 volts using a corona charger of the type described in U.S. Pat. No. 5,083,959, issued to Datta et al., on Jan. 28, 1992. The shadow mask 25 is inserted into the panel 12 and the positively charged OPC layer 34 is exposed, through the shadow mask 25, to actinic radiation, such as light from a xenon flash lamp disposed within a conventional three-in-one lighthouse. After each exposure, the lamp is moved to a different position to duplicate the incident angle of the electron beams from the electron gun. Three exposures are required, from the three different lamp positions, to discharge the areas of the OPC layer where the light-emitting phosphors subsequently will be deposited to form the screen 22. After the exposure step, the shadow mask 25 is removed from the panel 12 and the panel is moved to a first developer, such as that described in co-pending U.S. patent application Ser. No. 132,263, filed on Oct. 6, 1993. The developer contains suitably prepared dry-powdered particles of a light-absorptive black matrix screen structure material. The matrix material is triboelectrically negatively charged by the developer. The negatively charged matrix material may be directly deposited in a single step as described in U.S. Pat. No. 4,921,767, or it may be directly deposited in two steps as described in U.S. Pat. No. 5,229,234, issued to Riddle et al., on Jul. 20, 1993. The "two step" matrix deposition process increases the opacity of the resultant matrix. The light emitting phosphor materials are then deposited in the manner described in U.S. Pat. No. 4,921,767.

It also is possible to form a matrix using a conventional wet matrix process of the type known in the art and described, for example, in U.S. Pat. No. 3,558,310, issued to Mayaud on Jan. 26, 1971. If the matrix is formed by the wet process, then the photoreceptor is formed on the matrix and the phosphor materials are deposited in the manner described in U.S. Pat. No. 4,921,767.

As an alternative to both of the above-described "matrix first" processes, a matrix 123 can be electrophotographically formed after the phosphors are deposited by the EPS process. This "matrix last" process is described in U.S. Pat. No. 5,240,798, issued to Ehemann, Jr., on Aug. 31, 1993. FIG. 5 shows a screen assembly comprising a screen 122 and an overlying aluminum layer 124 made according to the "matrix last" process of U.S. Pat. No. 5,240,798.

In the "matrix last" process, the red-, blue-, and green-emitting phosphor elements, R, B and G, respectively, are formed by serially depositing triboelectrically positively charged particles of phosphor screen structure material onto a positively charged OPC layer 34 of the photoreceptor. The charging process is the same as that described above and in U.S. Pat. No. 5,083,959. After the three phosphors are deposited, the OPC layer 34 is again uniformly charged to a positive potential and the panel, containing the aforedeposited phosphor materials is disposed on a matrix developer which provides a triboelectrically negative charge to the matrix screen structure material. The positively charged open areas of the photoconductive layer, separating the phosphor screen elements, are directly developed by depositing onto the open areas the negatively charged matrix materials to form the matrix 123. This process is called "direct" development. The screen structure materials are then fixed and filmed as described in U.S. Pat. No. 4,921,767. The aluminum layer 124 is provided on the screen 122 for the purpose described above for the deposition of layer 24. It should be appreciated that the screen making process described above, can be modified by reversing both the polarity of the charge provided on the OPC layer 34 and the polarity of the triboelectric charge induced on the screen structure materials to achieve a screen assembly identical in structure to that described above.

Again with reference to FIG. 4, the OC layer 32 is formed by coating the interior surface of the panel 12 with an aqueous organic conductive solution comprising 2 to 6 weight percent (wt. %) of a quaternary ammonium polyelectrolyte, about 0.001 to 0.1, but preferably about 0.01 wt. %o of a suitable surfactant, about 0.5 to 2 wt. %, or less, polyvinyl alcohol (PVA), and the balance deionized water. In the case of a copolymer formulation, the conductive solution comprises 5 wt. % of an electrolyte, 0.05 wt. % of a surfactant, and the balance deionized water. The quaternary ammonium polyelectrolyte is a homopolymer selected from the group consisting of poly (dimethyl-diallyl-ammonium chloride); poly (3,4-dimethylene-N-dimethyl-pyrrolidium chloride) (3,4-DNDP chloride); poly (3,4-dimethylene-N-dimethyl-pyrrolidium nitrate) (3,4-DNDP nitrate); and poly (3,4-dimethylene-N-dimethyl-pyrrolidium phosphate) (3,4-DNDP phosphate). Alternatively, a suitable copolymer, such as vinylimidazolium methosulfate (VIM) and vinylpyrrolidone (VP) may be used in the conductive solution.

Poly(dimethyl-diallyl-ammonium chloride) is available commercially from the Calgon Corp., Pittsburgh, Pa., as Cat-Floc-C or Cat-Floc-T-2, and the copolymer of VIM and VP is available as MS-905, from BASF Corp., Persippany, N.J. The commercially available Cat-Floc materials contain 0.6 wt. % polyelectrolyte, 0.3 wt. % polyvinylpyrrolidone, and about 99 wt. % methylalcohol, as well as inorganic salts, such as NaCl and $K_2SO_4$ which do not bake out completely after panel bake. The chloride ion must be removed, or at least reduced in concentration, from the purchased materials before they can be used to make the organic conductor. The commercially available material costs about $0.20 per 100 g or about $0.002 per panel.

To remove the chloride ion bound to the organic polymer chain of the Cat-Floc material, a ten percent (10%) solution of Cat-Floc is dissolved in triple distilled water and mixed with ten percent (10%) solid anion exchange beads for two hours. The mixture is then filtered through a 5μ pressure filter and the Cat-Floc from the ion exchange is precipated from the solution with acetone. The precipitate is then washed with acetone:water, in a ratio of 80:20, and dissolved in water to make an aqueous solution containing 50 weight % of Cat-Floc. The pH of the chloride-free Cat-Floc is within the range of 12–13. The pH is adjusted to a pH of 4 by titration with 0.1% $HNO_3$ or 0.1% $H_3PO_4$.

The following examples are meant to illustrate the OC layer 32 in greater detail, but not to limit it in any way.

OC EXAMPLE 1

An organic conductor solution is formed by mixing the following ingredients thoroughly for one hour and filtering the solution through a 1 micron (μ) filter. The viscosity of the solution is 2.6 centipose (cp).

100 g (5 wt. %) of a 50% solution, in water, of Poly(-dimethyl-diallyl-ammonium chloride);
2 g (0.01 wt. %) of a surfactant, such as Pluronic L-72 (5% in water: methanol, 50:50) (available from BASF, Persippany, N.J.; and
900 g (balance) deionized water.

OC EXAMPLE 2

A second organic conductor solution is formed by mixing and filtering the following ingredients in the manner described in OC Example 1. The solution has a viscosity of 5 cp.

60 g (3.2 wt. %) of a 50% solution, in water, of Poly(-dimethyl-diallyl-ammonium chloride);
90 g (0.96 wt. %) of a 10% solution, in water, of polyvinyl alcohol (PVA);
2 g (0.01 wt. %) of a 5% solution, in methanol (50): water (50), of Pluronic L-72: and
778 g (balance) deionized water.

OC EXAMPLE 3

A third organic conductor solution is formed by mixing and filtering the following ingredients in the manner described in OC Example 1. The viscosity of the solution is 3 cp.

100 g (5.3 wt. %) of a 50% solution, in water, of Poly (3,4-DNDP chloride);
2 g (0.01 wt. %) of a 5% solution, in methanol (50):water (50), of Pluronic L-72: and
778 g (balance) deionized water.

The same amount of poly (3,4-DNDP nitrate) or poly (3,4-DNDP phosphate) may be substituted in the above solution for the poly (3,4-DNDP chloride).

OC EXAMPLE 4

A fourth organic conductor solution is formed by mixing and filtering the following ingredients in the manner described in OC Example 1. The viscosity of the solution is 1.9 cp.

100 g (5 wt. %) of a 50% solution, in water, of Cat-Floc-C;
2 g (0.01 wt. %) of a 5% solution, in methanol (50): water (50), of Pluronic L-72; and
900 g (balance) deionized water.

OC EXAMPLE 5

A fifth example of an organic conductive solution is formed by mixing and filtering the following ingredients as described in OC Example 1. The viscosity of the solution is 2.6 cp.

60 g (3.2 wt. %) of a 50% solution, in water, of Cat-Floc-C;
90g (0.96 wt. %) of a 10% solution, in water, of PVA;
2 g (0.01 wt. %) of a 5% solution, in methanol (50): water (50) of Pluronic L-72: and
778 g (balance) deionized water.

OC EXAMPLE 6

The following organic conductor solution is disclosed in U.S. Pat. No. 4,921,767, cited above, and is utilized as a control. The viscosity of the solution is 2.2 cp.

60 g (3 wt. %) of the ionene polymer 1,5 dimethyl-1, 5-dimethyldiazo-undeca-methylene-polymethobromide (available as Polybrene from Aldrich Chem. Co., Milwaukee, Wis.);

120 g (1.5 wt. %) of a 25% solution, in water, of polyacrylic acid (PAA);
1.5 g (0.004 wt. %) of a 5% solution, in methanol (50): water(50) of Pluronic L-72; and
1812 g (balance) deionized water.

OC EXAMPLE 7

100 g (5 wt. %) of MS-905 copolymer of vinylimidazolium methosulfate (VIM) and vinylpyrrolidone (VP);
3 g (0.01 wt. %) of a 5% solution, in methanol (50): water (50) of Pluoronic L-72; and
900 g (balance) deionized water.

Resistivity as a function of relative humidity was determined for the OC Examples given above. The solutions were coated onto glass slides. Coating thicknesses of 0.5, 1 and 2μ were produced and an ASTM-D 257 surface resistance measuring probe was used to determine the dc volume and surface resistance of the conductive films. The coated glass slides were stored for 24 hours at 5, 20, 30, 50, 60 and 90 percent relative humidity. Surface resistivity of all film samples was found to be independent of the film thickness, but dependent on the relative humidity. Table 1 lists the resistivity, in ohms/square, of films made from the six OC film examples, at 50% relative humidity (RH).

TABLE I

| OC Identification | Resistivity ohms/sq |
|---|---|
| Example 1 | $5 \times 10^7$ |
| Example 2 | $6 \times 10^8$ |
| Example 3 | $1.8 \times 10^7$ |
| Example 4 | $4 \times 10^7$ |
| Example 5 | $3 \times 10^8$ |
| Example 6 | $5 \times 10^{10}$ |
| Example 7 | $2 \times 10^7$ |

Results for Examples 3, 5 and 6 are shown in the graph of FIG. 6. Example 3 has the lowest resistivity and Example 5 is typical for the OC layer preferred in the current EPS process. The resistivity of Example 6, a prior OC, is too high for use in the EPS process below 50% relative humidity.

Chloride free material is preferred for the 0C layer 32 for CRT applications. Example 7, the above-mentioned MS-905, comprising VIM and VP, is chloride free and comprises about 90 wt. % VIM and 10 wt. % VP. The resistivity of MS-950 is $3\times10^6$ ohms/sq. and $3\times10^8$ ohms/sq. at 60% and 30% relative humidity, respectively.

The OPC layer 34 is formed by overcoating the OC layer 32 with an organic photoconductive solution comprising a suitable resin, an electron donor material, an electron acceptor material, a surfactant and an organic solvent. When dry, the solution forms a volatizable, organic photoconductive layer. The resin utilized in the photoconductive solution is selected from the group consisting of polystyrene, (such as Amoco 1R3P7 and G3, Dow Styron 666D and 615 APR), poly-alpha-methyl styrene (such as Amoco Resin-18-210), polymethylmethacrylate and esters of polymethacrylic acid (such as DuPont Elvacite-2013 and 2016), and polyisobutylene. The electron donor material is selected from the group consisting of tetraphenylethylene (TPE), triphenylethylene (TPE-2) and azulenes; and the electron acceptor material is selected from the group consisting of 2,4,7-trinitro-9-fluorenone (TNF); and 2-ethylanthroquinone (2-EAQ). The surfactant is silicone silar-100, available from General Electric Co., Waterford, N.Y., and the solvent is toluene.

The following examples are intended to illustrate the OPC layer 34 of the present invention in greater detail, but not. to limit it in any way.

OPC EXAMPLE 1

300 g (10 wt. %) of a polystyrene copolymer resin, such as Amoco 1R3P7, available from Amoco Chemical Co., Chicago, Ill., is added to 2648 g (about 87 wt. %) of toluene and stirred until the Amoco 1R3P7 is completely dissolved. Then, 75 g (2.5 wt %) of an electron donor material, such as, tetraphenylethylene (TPE) and 7.5 g (0.25 wt. %) of first electron acceptor material, such as, 2,4,7-trinitro-9-fluorenone (TNF) and 11.25 g (0.37 wt. %) of a second electron acceptor material, such as 2-ethylanthroquinone (2-EAQ), are added to the solution and stirred until all of the TNF and EAQ is dissolved. 0.15 g (0.005 wt. %) of a surfactant, such as silicone silar-100 is added as the solution is stirred. When all the constituents are dissolved, the resultant solution is filtered through a series of cascade filters having openings ranging in size from 10μ to 0.5μ. The viscosity of the filtered photoconductive solution is 32 cp. This solution is similar to the solution described in co-pending patent application, Ser. No. 08/168,486, filed on Dec. 22, 1993, and entitled, ORGANIC PHOTOCONDUCTOR FOR AN ELECTROPHOTOGRAPHIC SCREENING PROCESS FOR A CRT.

OPC EXAMPLE 2

The solution of OPC Example 2 is made in the manner described for OPC Example 1, and contains the following ingredients:
300 g (10 wt. %) of Amoco Resin-18-210;
75 g (2.5 wt. % ) of (TPE);
7.5 g (0.25 wt. %) of (TNF);
11.25 g (0.37 wt. %) of (2-EAQ);
0.15 g (0.005 wt %) of silicone silar- 100; and
2648 g (balance) toluene.

After mixing and filtering through the cascaded filters, the viscosity of the solution is 12 cp.

OPC EXAMPLE 3

The solution of OPC Example 3 is made in the manner described for OPC Example 1, and contains the following ingredients:
300 g (10 wt. %) of Elvacite 2013, available from DuPont, Wilmington, Del.;
75 g (2.5 wt. %) of (TPE);
7.5 g ( 0.25 wt. %) of (TNF);
11.25 g (0.37 wt. %) of (2-EAQ);
0.15 g (0.005 wt. %) of silicone silar-100; and
2648 g (balance) toluene.

After mixing and filtering through the cascaded filters, the viscosity of the solution is 21 cp.

While the three listed examples of OPC solutions utilize a weight ratio of 4 parts resin to 1 part electron donor material, it has been determined that the ratio can vary from 8 parts resin and one part electron donor material to 2 parts resin, one part donor material. At the 8:1 ratio the photoconductivity of the solution is reduced, and at a ratio of 2:1 the formulation tends to become unstable, causing the electron donor material to begin to precipitate out of the solution. In order to optimize the sensitivity of the solution and the performance of the OPC layer produced therefrom, the ratio of resin to electron donor material preferably should be within the range of 4:1 to 6:1. It has been determined that the total of the two electron acceptor materials should be within the range of 0.05 to 1.5 wt % of the total weight of the solution. All of the OPC solutions were diluted with toluene to obtain samples with viscosities of 12 and 32 cp. These OPC solutions were coated of 20 V (20 inch diagonal dimension) faceplate panels which were previously coated with a suitable OC layer having a viscosity of 9 cp. The preferred coating method is to "spin coat" by depositing a quantity of material and then spinning the panel to uniformly disperse the solution and create a layer of substantially uniform thickness. The OPC's had a thickness of 4μ and 10μ, for viscosities of 12 and 32 cp. respectively.

Of the three OPC formulations described, OPC Example 2 if preferred for the present combined screen bake-out and frit sealing process because the poly-alpha-methyl-styrene resin, Amoco Resin-18-210, bakes-out substantially completely. The electron acceptors, TPE, TPE-2 and the Azulenes, sublime at temperatures less than 300° C. OPC's made using TPE have similar photoconductive properties to that of 2,4-DMPBT, described in co-pending patent application, Ser. No. 08/168,486, referenced above.

All OPC layers formed using the solutions described in the present OPC Examples 1 through 3, were analyzed with a thermogravimetric analyzer (TGE), isothermally, at 440° C. Weight loss of the OPC layers was determined by raising the temperature of the sample from room temperature (~23° C.) at a rate of 10° C. per minute, until a temperature of 440° C. was reached. The samples were held at 440° C. for 180 minutes. Thermal decomposition of the OPC layer begins at 225° C. and progresses rapidly so that 99% of the weight of the layer has decomposed at 350° C., i.e., 12.5 minutes before the temperature of the sample reaches 440° C. This rapid decomposition of the present OPC's is to be contrasted to that of the OPC's (utilizing electron donor materials such as 1,4-di(2,4-methyphenyl)-1,4diphenyl butatriene (2,4-DMPTB); (2,5-DMPBT); (3,4-DMPBT); (2-DMPBT); (2-DPBT); (4-DFPBT); (4-DBPBT); (4-DCPBT) or (4-DTFPBT) described in co-pending application, Ser. No. 08/168,486 referenced above. OPC's utilizing the electron donor materials of the co-pending application begin to thermally decompose at 225° C. and rapidly decompose to 96% of their weight at 425° C., in 30 minutes, but then decompose at a slow rate to 99.5% of their weight at 440° C. in an additional 80 minutes. For comparison purposes, conventional PVA/dichromate photoresists, such as those used in U.S. Pat. No. 3,558,310, referenced above, begin to decompose at 150° C. and experience a 93% weight loss at 350° C. in 20 minutes. However, seven percent of the residual material remains at 440° C., even after a 180 minute bake. The residue in the conventional photoresist is inorganic dichromate. It is concluded from these tests that the electron donor material TPE, used in the present OPC formulations, bakes out more cleanly and at much lower temperatures than either the prior conventional materials, or the materials described in co-pending application, Ser. No. 08/168,486. Also, the resins used in the present OPC's form solid solutions with the TPE to prevent crystallization of the TPE, thus reducing the likelihood of electrical breakdown of the OPC layer at thicknesses within the range of 3–5μ. Preliminary studies indicate that the electrical breakdown voltage for the OPC made with TPE is 50 to 100 volts higher than for the materials of co-pending application, Ser. No. 08/168,486, so that fewer defects in either the matrix or the phosphor lines occur with TPE.

A number of 20 V (20 inch diagonal) faceplate panels were coated to form an OC layer containing an aqueous solution of Cat-Floc, PVA and a small quantity of a surfactant. This OC solution is identified as 0C Example 5 above. The OC layer of Example 5 was then overcoated with the OPC of Example 1, supra. Samples were made having viscosities of 12 and 32 cp to provide panels having OPC layer thickness of 4μ and 10μ, respectively.

The 4μ OPC layer was corona charged to 505 volts, and when held in the dark for 90 seconds, the voltage (hereinafter called the dark voltage) decayed to 415 volts. The 4μ OPC layer was then exposed, through a shadow mask, to 10 flash exposures from a lighthouse containing a xenon lamp. The surface voltage, after exposure was reduced to 190 volts.

The 10μ OPC layer was charged to 740 volts and the dark voltage after 90 minutes had decayed to 687 volts. After 20 flash exposures, through a shadow mask, the surface voltage of the thicker OPC layer was reduced to 250 volts. The thicker OPC layer seems to have higher residual voltage, compared to the thinner layer.

The panel with the 4 μ OPC layer was recharged to 500 volts and developed using a blue phosphor, according to the method described in U.S. Pat. No. 4,921,767. The phosphor lines were well defined with no background, i.e., no phosphor was deposited in areas of the OPC reserved for another color-emitting phosphor or for a matrix line. Four additional 20 V panels were screened by depositing all three color-emitting phosphors in the manner described in U.S. Pat. No. 4,921,767. The panels were filmed, aluminized and baked for 4 hours and 10 minutes, including 1 hour at 440° C. Both the OC and the OPC baked out clean without any brown carbonaceous residue.

Figure 7:
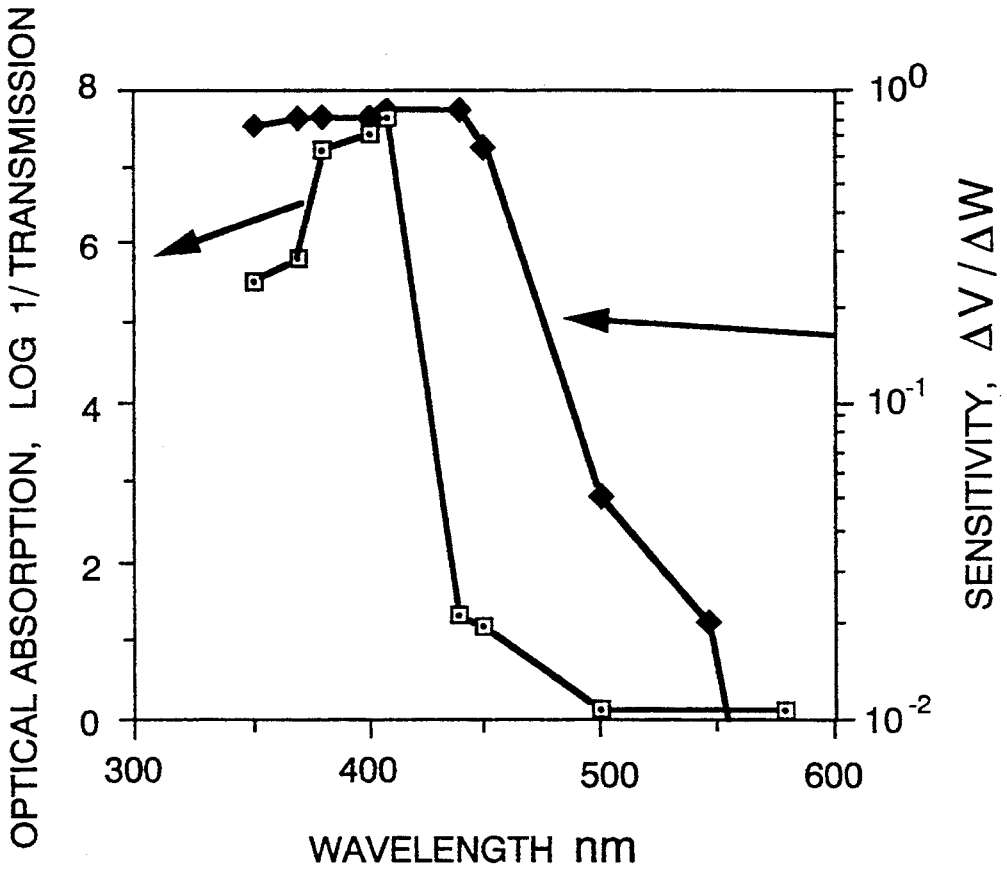
FIG. 7 is a graph of the optical absorption and the spectral sensitivity of a photoconductive layer overlying a conductive layer of the present invention.

OPC's made according to Examples 2 and 3 were evaluated on glass slides for bake-out characteristics. Both samples baked-out at 440° C. without residue. The OPC formulations of the present invention are very transparent at 400 to 450 nm and may benefit from the addition of a dye to reduce the transparency and reflections from the surface of the glass substrate, which in the samples caused ghost images. The optical absorption of the OPC, defined as the log of the reciprocal of the transmission, is shown in FIG. 7. The spectral sensitivity of the OPC layers of the present invention, also shown in FIG. 7, experiences a sharp drop-off from 500 to 550 nm, and substantially no sensitivity exists beyond 550 nm, making the OPC layers suitable for processing in yellow light, which has a wavelength of ~577 to 597 nm. This means that since the OPC layer has substantial no sensitivity beyond 550 nm, it is not necessary to process screens in the dark, or in subdued light, thus making the EPS process safe in a manufacturing environment.

Screens made using the present OPC's of Examples 1–3 are suitable for a combined panel bake-out- frit sealing process. After the screen structure materials comprising matrix and phosphors are deposited onto the photoreceptor, fixed, filmed and aluminized, a shadow mask 25 is located within the panel, and a bead of frit material is applied to the sealing edge of either the panel 12 or the funnel 15. The panel is placed on the funnel so that the sealing edges are aligned and the funnel and panel are supported within a suitable oven. The oven heats the funnel and panel to a temperature of 440° C. over a time period sufficient to simultaneously set the frit and volatilize at least the photoreceptor and the volatilizable constituents of the screen structure materials and the filming materials.

What is claimed is:

1. In a method of manufacturing a luminescent screen assembly for a color CRT including a faceplate panel having a sealing edge sealed to a funnel also with a sealing edge, comprising the steps of:

a) providing a volatilizable photoreceptor on an interior surface of said panel by i) coating an interior surface of said panel with an aqueous organic conductive solution to form a volatilizable conductive layer; and ii) overcoating said conductive layer with an organic photoconductive solution comprising a suitable resin, an electron donor material, at least one electron acceptor material, a surfactant and an organic solvent, to form a volatilizable photoconductive layer having substantially no spectral sensitivity at wavelengths in excess of 550 nm;

b) establishing a substantially uniform electrostatic charge on said photoconductive layer;

c) exposing selected areas of said photoconductive layer to actinic radiation to affect the charge thereon;

d) developing said photoconductive layer with at least one dry, light-emitting, triboelectrically-charged screen structure material;

e) fixing said screen structure material to said photoconductive layer to minimize displacement of said screen structure material;

f) filming said screen structure material with a suitable filming material;

g) aluminizing the filmed screen structure material;

h) locating a color selection electrode within said panel;

i) providing a bead of frit material on one of said sealing edges, and placing said panel on said funnel with said seal edges in alignment;

k) supporting said funnel and said panel in a suitable oven;

l) heating said funnel and said panel to a temperature above the set temperature of said frit material for a time period sufficient to simultaneously set said frit material and volatilize said photoreceptor and the volatilizable constituents of said screen structure material and said filming material; the improvement wherein said resin of said photoconductive solution being selected from the group consisting of polystyrene, poly-alpha-methyl styrene, polymethylmethacrylate and esters of polymethacrylic acid, and polyisobutylene;

said electron donor material being selected from the group consisting of tetraphenylethylene (TPE), triphenylethylene (TPE-2) and azulenes, said donor material being substantially completely decomposed at a temperature below the set temperature of said frit; and said electron acceptors comprising 2,4,7-trinitro-9-fluorenone(TNF) and 2-ethylanthroquinone(2-EAQ).

2. In a method of manufacturing a luminescent screen assembly for a color CRT on an interior surface of a faceplate panel with a sealing edge sealed to a funnel also with a sealing edge, comprising the steps of:

a) providing a volatilizable photoreceptor on said interior surface of said panel by i) coating said interior surface of said panel with an aqueous organic conductive solution to form a volatilizable conductive layer; and ii) overcoating said conductive layer with an organic photoconductive solution comprising 5 to 15 wt. % of a suitable resin, about 2.5 wt. % of an electron donor material, about 0.6 wt. % of at least two electron acceptor material, about 0.005 wt. % of a surfactant and the balance being an organic solvent, to form a volatilizable photoconductive layer having substantially no spectral sensitivity at wavelengths in excess of 550 nm;

b) establishing a substantially uniform electrostatic charge on said photoconductive layer;

c) exposing selected areas of said photoconductive layer to actinic radiation to affect the charge thereon;

d) developing said photoconductive layer with at least one dry, light-emitting, triboelectrically-charged screen structure material;

e) fixing said screen structure material to said photoconductive layer to minimize displacement of said screen structure material;

f) filming said screen structure material;

g) aluminizing the filmed screen structure material;

h) locating a color selection electrode within said panel;

i) providing a bead of frit material on one of said sealing edges, and placing said panel on said funnel with said seal edges in alignment;

j) supporting said funnel and said panel in a suitable oven; and k) heating said funnel and said panel to 440° C. for a time period sufficient to simultaneously set said frit material and volatilize at least said photoreceptor and the volatilizable constituents of said screen structure material and said filming material, the improvement wherein said resin of said photoconductive solution being selected from the group consisting of polystyrene, poly-alpha-methyl styrene, polymethylmethacrylate and esters of polymethacrylic acid, and polyisobutylene;

said electron donor material being selected from the group consisting of tetraphenylethylene (TPE), triphenylethylene (TPE-2) and azulenes, said donor material being substantially completely decomposed at a temperature of 350° C.; and said electron acceptors comprising 2,4,7-trinitro-9-fluorenone (TNF) and 2-ethylanthraquinone(2-EAQ).

* * * * *

UNITED STATES PATENT AND TRADEMARK OFFICE

CERTIFICATE OF CORRECTION

PATENT NO. : 5,405,722

DATED : April 11, 1995

INVENTOR(S) : Pabitra Datta et al.

It is certified that error appears in the above-identified patent and that said Letters Patent is hereby corrected as shown below:

Patent

Col. 1, line 41, after "wet process"
add —,—;

Col. 7, line 44, change "0C" to
—OC—;

Signed and Sealed this

Twenty-seventh Day of June, 1995

Bruce Lehman

*Attest:*

BRUCE LEHMAN

*Attesting Officer*

*Commissioner of Patents and Trademarks*